United States Patent [19]

Catterfeld

[11] 3,946,556

[45] Mar. 30, 1976

[54] INTEGRATED NOZZLE AND STEERING MECHANISM FOR WATERJETS

[75] Inventor: Fritz C. Catterfeld, Canoga Park, Calif.

[73] Assignee: Rockwell International Corporation, El Segundo, Calif.

[22] Filed: Oct. 25, 1974

[21] Appl. No.: 518,012

[52] U.S. Cl. ..... 60/221; 115/12 R; 115/16; 60/232; 239/265.35; 239/265.19

[51] Int. Cl.[2] ..... B63H 11/10

[58] Field of Search ..... 60/221, 222, 232; 115/12 R, 16; 239/265.19, 265.35

[56] References Cited

UNITED STATES PATENTS

| | | | |
|---|---|---|---|
| 2,993,463 | 7/1961 | McKinney | 60/222 X |
| 3,138,922 | 6/1964 | Englehart | 60/222 |
| 3,143,857 | 8/1964 | Eaton | 115/12 R |
| 3,187,708 | 6/1965 | Fox | 115/12 R |
| 3,426,724 | 2/1969 | Jacobson | 115/12 R |
| 3,525,475 | 8/1970 | Schweikl | 60/232 X |
| 3,788,265 | 1/1974 | Moore | 115/12 R |

*Primary Examiner*—Clarence R. Gordon
*Attorney, Agent, or Firm*—L. Lee Humphries; Robert G. Upton

[57] ABSTRACT

An integrated nozzle is designed to deflect the jet from a waterjet pump in a watercraft before it leaves the nozzle for watercraft steering. The nozzle may be so configured to be steerable in both the horizontal and vertical planes. The integrated nozzle and steering mechanism with thrust reversal mechanism attached thereto allows a full thrust capability without appreciable friction losses inherent in conventional waterjet steering buckets.

2 Claims, 8 Drawing Figures

INTEGRATED NOZZLE AND STEERING MECHANISM FOR WATERJETS

The invention herein described was made in the course of or under a contract or subcontract thereunder, (or grant) with the U.S. Navy.

BACKGROUND OF THE INVENTION

1. Field of the Invention

This invention relates primarily to the waterjet field and more specifically to providing a method to direct a stream of water or fluid to steer the waterjet vessel in such a manner that minimal power losses occur as a result of the redirection of the stream of water or fluid from the waterjet.

2. Description of the Prior Art

There are many patents in the prior art that are directed to a means to deflect a stream of water from a waterjet to provide thrust vectoring either in the horizontal or vertical plane. All of the prior art patents known to the Applicant deflect a solid stream of water from a waterjet pump after the stream has already reached its peak velocity, thus any interference with the stream of water will reduce the overall thrust efficiency through friction losses. For example, U.S. Pat. No. 3,143,857 describes a waterjet device wherein the water is accelerated through an axial flow-type of pump. The pump discharges into a separate jet nozzle which is pivotable about a spherical housing in a horizontal plane. Additionally there is a reversing bucket associated with the pivotal housing to direct the water discharged into the nozzle housing in an opposite direction. Friction losses are incurred when the water being accelerated through the pump are directed into a separate nozzle. The more the steering nozzle is deflected, the greater the friction losses. Obviously, power is lost through increased friction in the transition distance between the internal fixed nozzle and the deflected separate external nozzle associated with the spherical housing. An obvious disadvantage then, is the separate swivel nozzle that deflects a solid stream of water from a fixed pump and deflects the stream to steer the waterjet.

U.S. Pat. No. 2,993,463 describes a waterjet having a pair of alternating nozzles, one or the other of which communicates with an outlet opening from a waterjet pump. One of the nozzles being directed 180° to the direction of the other to provide for a reverse function for a watercraft. This device, like the foregoing patent, is disadvantaged in that the water accelerated through the pump is redirected after it passes through a primary opening, thus frictional losses similar to that which occurs in a pipe elbow are incurred with increased deflection of the secondary nozzles.

The patents described above are but examples of many similar patents in the prior art. All of the prior art water propulsion devices deflect a primary stream of water from a pump or the like to effect steering, reversing etc. The more the angular deflection of the nozzle, the greater the propulsion losses are incurred thereby diminishing the propulsion efficiency. The present invention overcomes this serious problem by vectoring fluid or water upstream of the nozzle where full velocity is achieved. The accelerated water is directed through a specific horizontal or vertical plane without serious frictional losses.

SUMMARY OF THE INVENTION

The invention consists primarily of a waterjet having a spherical nozzle portion attached thereto. An inner concentric bulbous-shaped body is spaced from and surrounded by a first outer spherically shaped housing, which together with the inner body serves to direct water therebetween. A second outer housing with a nozzle opening therein is interfitted with and hinged to the outer spherical surface of the first housing so that the second outer body with an internal spherical surface may traverse in a substantially horizontal arc. The hinge line being substantially vertically disposed thus, directing water to the right, left, or straight aft, depending upon the desired direction of the watercraft. A reversing bucket is attached to the second outer housing. The bucket is comprised of a clam-shell type arrangement, the bottom half of the shell is permanently affixed to the second housing, while the top half is a separate hinged half-bucket that is swiveled out of the way during normal watercraft operation. The separate top half of the clam shell is dropped down over the exhaust orifice in the second housing, the upper clam shell mating with the fixed bottom shell, thus directing the water in an opposite direction.

The steerable reversing system is designed to deflect the jet of water before it leaves the discharge nozzle. The reversing mechanism can deflect the jet stream from neutral through a large angle to provide reverse thrust. The system is designed for full thrust capacity while encompassing the steering mode of operation. The steerable ball joint nozzle traverses substantially horizontally through an arc of approximately 30° in each direction from the center line of the pump.

The separate reversing bucket is hinged through a horizontal plane on the nozzle and closes in a vertical direction. The bucket partially closed provides a means wherein a neutral propulsion position is achieved, whereby water is deflected both rearwardly and forwardly, thereby reaching an equilibrium. The bucket is actuated, for example, with two hydraulic devices mounted on each side of the fixed deflector passage wall.

The instant steering and reversing device when compared with prior art waterjet devices sustains less propulsion losses when the water is deflected during steering maneuvers.

Therefore it is an object of this invention to provide a means to steer a waterjet powered vehicle with little or no propulsion losses due to the redirection of the annular water flow through the waterjet propulsion device.

More specifically it is an object of this invention to provide a steerable waterjet having a ball-type nozzle portion deflectable through a substantially horizontal plane, the ball portion providing the nozzle for accelerated water that is directed through an annular passageway defined by an outer cylindrical portion and an inner concentric body or pintle. The integrated nozzle steering mechanism has additional means to reverse the direction of the water being propelled through the waterjet device.

Accordingly, an advantage over the prior art is a means to steer a watercraft with minimal propulsion losses when accelerated water is redirected by an integral steerable nozzle.

The above-noted objects and advantages of the present invention will be more fully understood upon a study of the following detailed description in conjunction with the detailed drawings.

BRIEF DESCRIPTION OF THE PREFERRED EMBODIMENTS

Figure 1:
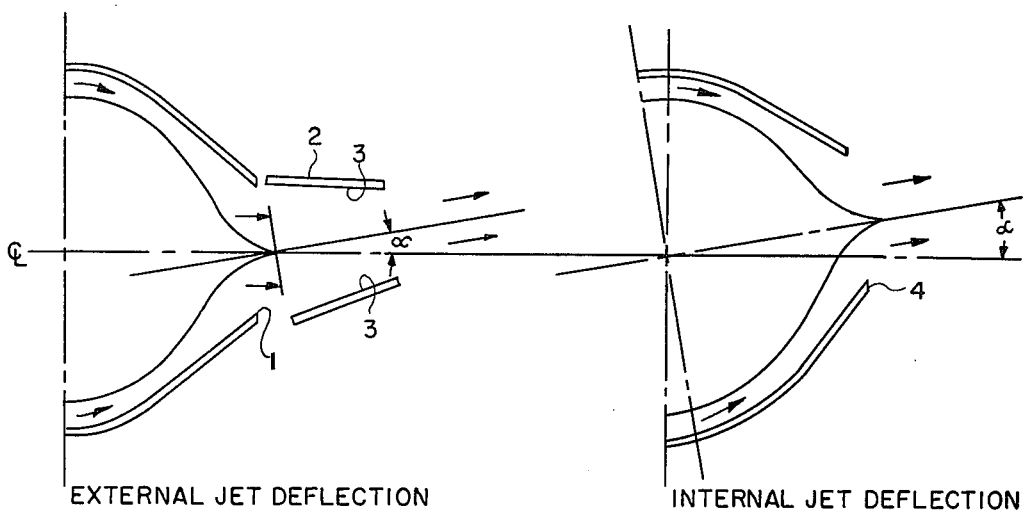
PRIOR ART FIG. 1
FIG. 1 is a schematic view of the principal element of the instant invention.

A major constraint in the performance of a thrust vectoring device is cavitation because optimum nozzle thrust requires maximum exit flow velocities short of the cavitation limit. Referring to the schematically shown prior art, water coming in contact with any flow deflecting surfaces 3 of deflection nozzle 2 must not be further accelerated. An example of this is shown wherein flow from a primary nozzle 1 is further accelerated by secondary deflection nozzle 2. An important criterion in the design of an efficient flow deflecting device is that the maximum amount of flow issuing from the nozzle be captured. The high velocity jet impinging on the deflector surface 3 will result in additional viscous losses and consequent reduction in the primary nozzle efficiency. Contact between the jet and the deflective surfaces must be avoided in the neutral position to prevent loss in primary nozzle efficiency. Consequently, the jet deflector 2 must be moved a distance before any jet deflection is accomplished. This dead band effect must be provided for in the control system further complicating the operation of a watercraft and effective steering control depends on the particular power level of the jet at the time of steering. Prolonged deflection over long distances such as might be encountered in a cross-wind or cross-current condition will necessarily result in a loss in power and an increase in fuel consumption.

Figure 2:
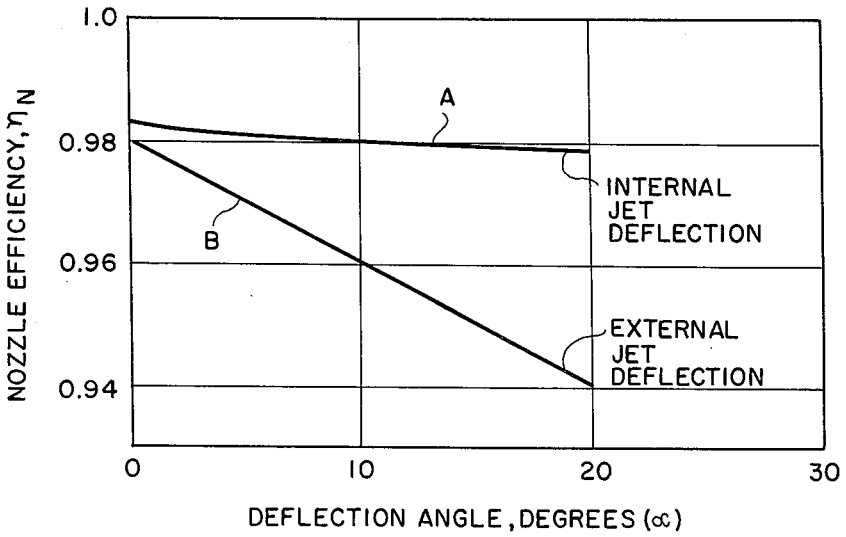
FIG. 2 is a graph illustrating the difference between the prior art externally deflected secondary nozzle and the internally deflected nozzle of the present invention.

The schematic of FIG. 1 shows the preferred vectoring of the jet by rotation of the nozzle 4 as an efficient method of jet deflection for steering. In this method, the fluid or water is vectored upstream of the nozzle 4 where full jet velocity is achieved. The effect of deflection angle on the nozzle efficiency can be computed as depicted in FIG. 2 by considering the change in meridianal flow path due to deflection. The estimated nozzle efficiency of upstream (internally) deflected jet (line A) in relation to deflection angle as compared to the efficiency to the prior art device (line B) is clearly indicated by the graph. A 20° deflection of deflection nozzle 2 of the prior art results in a four-point loss of propulsion efficiency when compared to the internally deflected jet of the instant invention.

Figure 3:
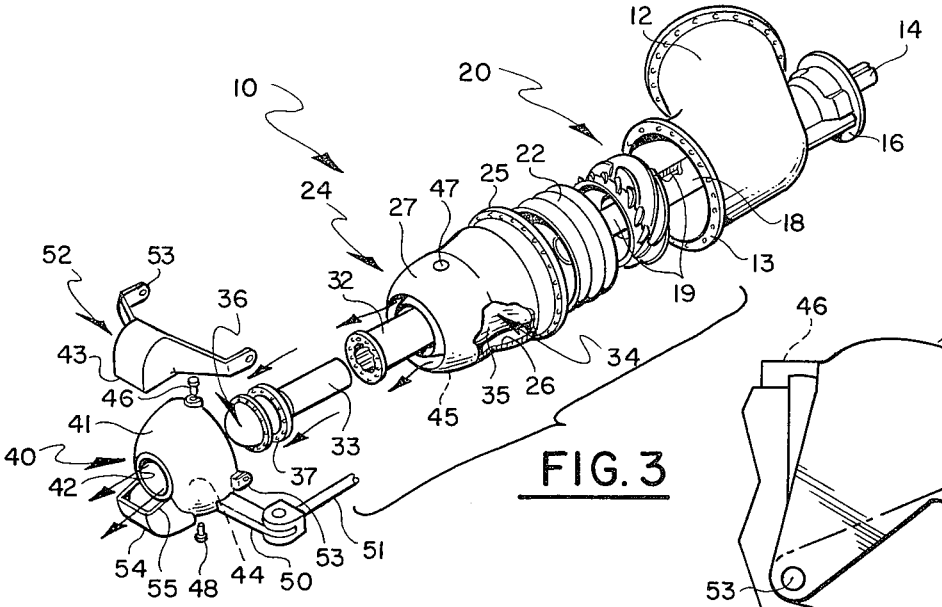
FIG. 3 is an exploded perspective view of an overall waterjet device illustrating the various components involved relative to the integrated nozzle and steering mechanism of the waterjet.

Referring now to FIG. 3 the waterjet pump generally designated as 10 is comprised of an inlet elbow 12 that is connected to a water inlet ramp associated with a watercraft (not shown). A power plant drive shaft 14 is connected to a power plant (not shown), the drive shaft being directed through the elbow section 12 through a bearing housing 16. Drive shaft 19 is directed through a tubular housing 18 into the inlet housing 12, the drive shaft 19 is connected to an inducer generally designated as 20. Shaft 19 terminates within an inducer drive shaft bearing 32 in support housing 34. Surrounding inducer 20 is an inducer shroud 22. An outer housing 24 with peripheral flange 25 mates with flange 13 of housing 12. An inner pump housing 34 is positioned concentrically within outer housing 24. The inner housing 34 is separated and supported by a series of support webs 28 (FIG. 5) which double as fluid or water flow straighteners. Inducer drive shaft bearing 32 is positioned concentrically within the housing 34. A bearing sleeve 33 surrounds the end of shaft 19. A dome-spherical cap generally designated as 36 is mounted to the inducer drive shaft support housing 34 through flange 37. The cap 36 rounds out the end of the inner pump housing 34, thus enclosing the inducer drive shaft 19. An annulus 29 (FIG. 5) is formed between the housing wall 35 of inner pump housing 34 and inner wall 26 of the outer spherical housing 24. The support webs flow straighteners 28 are positioned between the inner and outer housings 34 and 24, the water being directed therebetween. An outer spherical steerable housing nozzle generally designated as 40 attaches to outer housing member 24 through an upper pin 46 interfitted within receptacle 47 and a lower pin 48 interfitted within receptacle 45 formed within housing 24. The hinge pin arrangement enables the spherical nozzle housing to be steerable in a horizontal plane. A nozzle opening 42 is formed by nozzle housing member 40. Below the nozzle portion 42 is a fixed lower half of a reversing bucket, designated as 54. The clam-shell type reversing bucket is a housing that directs the water in the opposite direction when the separate upper half of the reversing bucket, generally designated as 52 is mated with fixed bucket 54 when complementary edges 43 and 55 come together. The separate swivable bucket 52 is hinged to the steerable nozzle housing 40 through receptacle 53 on each side of the steerable nozzle 40. The hinge line for the bucket is on a horizontal plane so that the reversing bucket drops down through a vertical plane. The inner surface 44 of the integrated nozzle 40 serves to direct the exiting water out through nozzle portion 42 of the steerable reversing device 40. A steering horn 50 is affixed to the outer surface 41 of nozzle housing 40. A steering arm 51 is connected to horn 50 and terminates in a steering mechanism within the watercraft (not shown).

In operation (FIGS. 3 and 5) water is directed through inlet elbow 12 into the inducer 20, the water being driven by the inducer 20 through shroud 22 into annulus 29 formed between the inner concentric pintle body 34 and the outer cylindrical body 24. The accelerated water is then directed through the support web flow straighteners 28 towards the steerable spherical nozzle housing 40. The water impacts the inner surface 44 of nozzle body 40 and is directed out through nozzle 42 to propel the watercraft through the water. It can be readily seen that nozzle 42 may be positionable through a horizontal arc without materially degrading the efficiency of the accelerated water exiting the nozzle.

Figure 4:
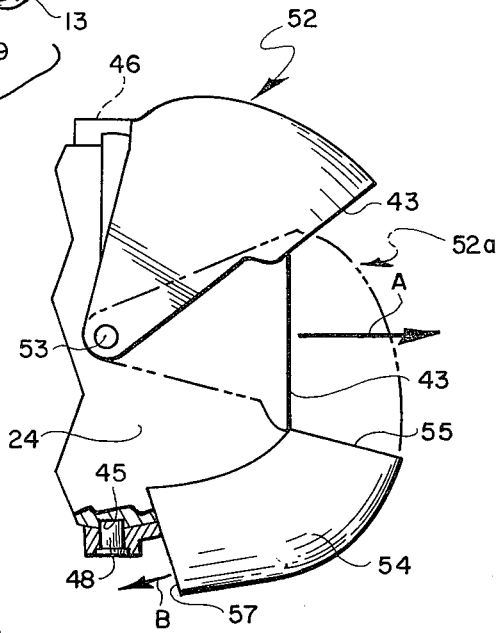
FIG. 4 is a partially cut-a-way side view of the nozzle portion of the integrated nozzle illustrating the reversing bucket in both the open and closed position.

Turning now to FIG. 4, the cross-sectional view of the waterjet pump 10 illustrates the upper hinge pin 46 and lower pin 48 which swivels the nozzle portion 40 in a substantially horizontal plane. The pins 53 connecting the separate reversing bucket portion 52 is additionally shown. Normally, the waterjet pump accelerates water out of nozzle 42 in direction "A," thereby propelling the watercraft through the water in a forward direction. When reversing bucket 52 is dropped down so that the surfaces 43 and 55 are mated together, the water is then directed into direction "B," thus driving the watercraft in the reverse direction. Obviously, if the steerable spherical nozzle housing 40 is steerable in a horizontal plane in the forward direction, it is also steerable in a horizontal plane in a reverse direction. The water when reversed exits nozzle portion 57.

Figure 5:
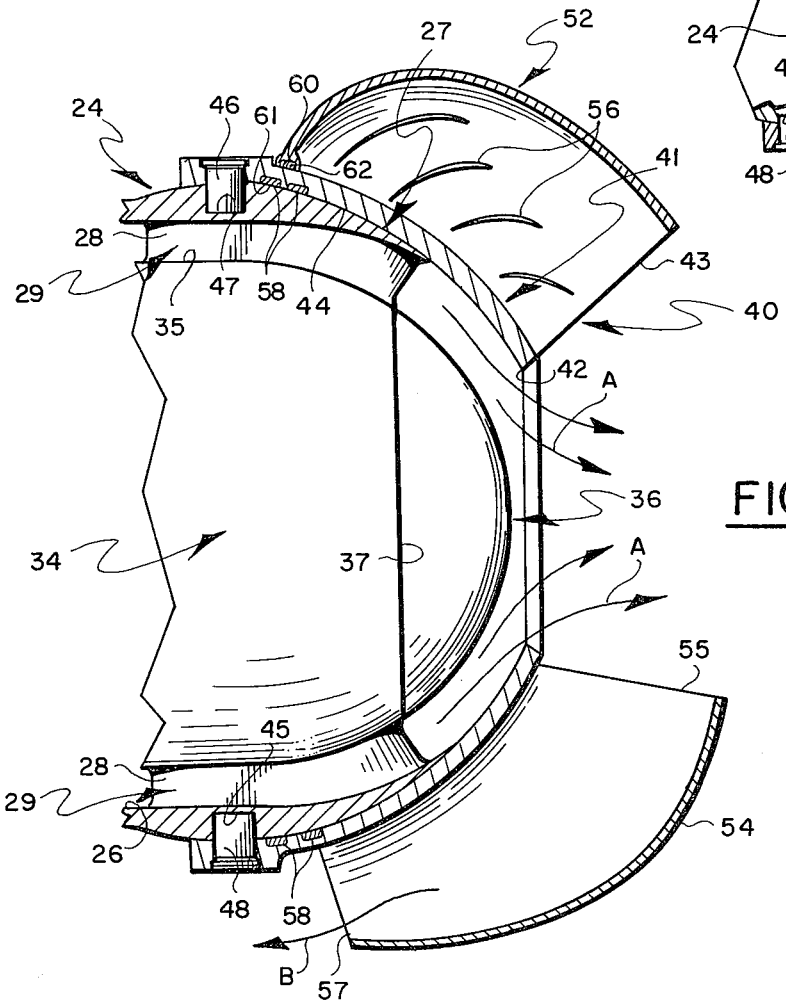
FIG. 5 is a cross-sectional side view of the device illustrating the inner and outer body with the webs supporting the two sections along with the reversing bucket in an inoperative position.

Referring to FIG. 5 the cross-sectional view illustrates more clearly the concentricity of inner and outer housing 34 and 24. The support web flow straighteners 28 are positioned between inner and outer housings 34, 24 and equidistantly spaced around the annular space 29 formed therebetween. The spherical nozzle portion 40 nestles within outer housing member 24 along outer surface 27 of housing 24 and inner surface 44 of nozzle portion 40. Seals 58 are recessed into a groove 61 in wall 44 of nozzle 40. The seals, for example, could be rubber O-rings or teflon rings depending upon the chemical concentrations of the fluid or water the waterjet is going to be subjected to. The separate reversing bucket 52 has a series of turning vanes 56 internally positioned within bucket 52. The turning vanes serve to help redirect the water from nozzle 42 in the direction "B" through nozzle 57 of fixed reversing bucket 54. A seal 60 is positioned within recess portion 62 in the lip of the movable bucket portion 52. Both seals 58 in steerable nozzle 40 and seal 60 in reversing bucket 52 serve to prevent the entrance of any water impurities that might wedge between inner wall 44 of steerable nozzle 40 and outer surface 27 of housing 24. The seals then serve the dual function of keeping the sliding surfaces clean of foreign residue as well as to seal between outer and inner bodies.

It can readily be seen in FIG. 5 that the water accelerated through annulus 29 between inner body 34 and outer body 24 as it exits past spherical domed portion 36 which closes out housing 34 may exit anywhere that the nozzle portion 42 of housing 40 is positioned with minimal frictional losses in the velocity of the water being accelerated through the nozzle. Thus the nozzle 42 may be in position anywhere in a horizontal plane adjacent spherical portion 36 without incurring significant efficiency losses.

Figure 6:
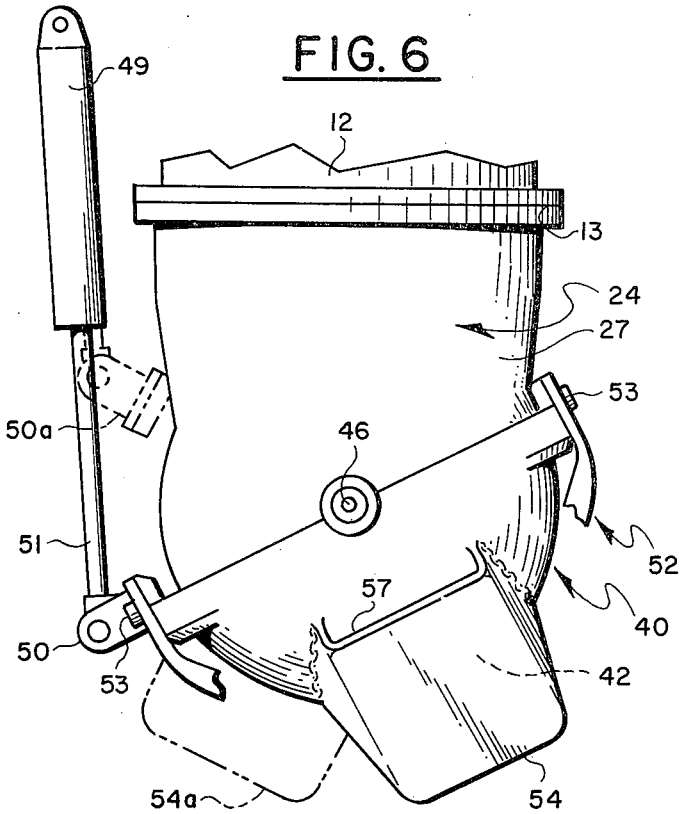
FIG. 6 is a top view of the nozzle device illustrating the steering actuating mechanism.

Referring to FIG. 6 it can be seen that the steerable nozzle portion 40 may be positioned upwards to 30° from the center line in a horizontal plane. FIG. 6 is a view looking up at the bottom of the waterjet 10 illustrating the fixed reversing bucket portion 54 with the exit nozzle 57 being plainly in view. The fixed horn portion 50 is attached to nozzle 40, the steering device 51 is extended from the hydraulic steering device 49 which may be, for example, affixed to the stern of the watercraft (not shown). The nozzle portion 40 is shown in an alternate position 54*a* through horn 50*a*.

Figure 7:
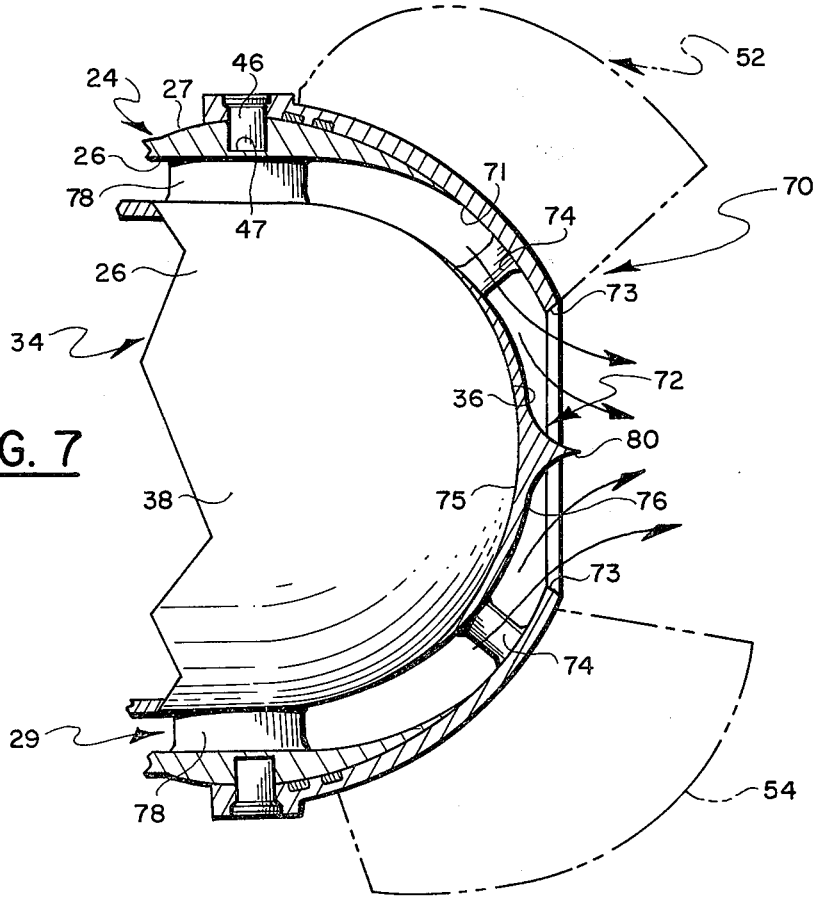
FIG. 7 is a cross-sectional side view of a different embodiment of the invention.

FIG. 7 depicts a different embodiment wherein the spherical steerable nozzle housing 70 has affixed to it a nozzle center piece generally designated as 72. The inner concave surface 75 of center piece 72 slidably mates with the outer surface of the half sphere or domed-spherical inner pump housing cap 36. The center piece is spaced from and affixed to the movable nozzle portion 70 by a multiplicity of webs 74 which are equidistantly spaced between the inner wall 71 of movable nozzle 70 and outer wall 76 of center piece 72. A spike portion 80 of the center piece 72 is extended into the center of nozzle opening 73 of spherical nozzle portion 70. The purpose of the center piece with the extended spike portion 80 is to provide a transition member for the accelerated water that exits past nozzle 73 outwardly of the waterjet pump 10. As fluid or water exits the nozzle 42 as depicted in FIGS. 3–6, it creates a turbulent flow adjacent inner sphere 36, thereby creating resistance to flow leaving nozzle 42. The spike 80 of floating center piece 72 (FIG. 7) which rides on cap 36 smooths out this turbulent flow of water adjacent cap 36 providing a smooth transition for the accelerated water as it exits past nozzle 73.

Figure 8:
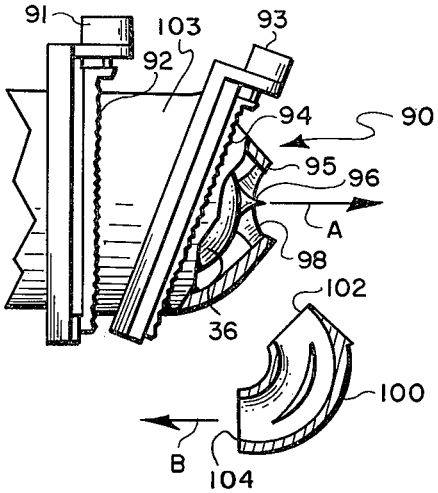
FIG. 8 is still another version of the integrated nozzle illustrating a means to steer the existing jet in the vertical direction as well as in the horizontal direction.

FIG. 8 depicts still another embodiment wherein both horizontal and vertical deflections are possible in an almost infinite variety of positions. The figure basically depicts a different means to deflect the movable nozzle portion generally designated as 90. A side view of the waterjet device illustrates a geared ring 92 attached to a transition member 103 that rotates 360° nozzle portion 90 in a plane perpendicular to the center line of the pump while a second geared ring 94 rotates the nozzle portion 90 on a bias or at an oblique angle to the center line of the housing so that when the gear rings 92 and 94 work together driven by servo motors 91 and 93, the nozzle 95 may be positioned both horizontally and vertically. Hence, the watercraft may be both steered by directing the nozzle horizontally and trimmed by positioning the nozzle in a vertical direction to change the "pitch" of the watercraft. A reversing bucket 100 may be fixed to the watercraft transom below the movable nozzle portion 90. The nozzle having vertical deflection capabilities may be positioned to direct the discharge from the nozzle 95 into opening 102 and forwardly out of opening 104 in direction "B" of the fixed reversing nozzle 100. The embodiment of FIG. 8 additionally shows the spike 96 with supporting webs 98 between the steerable nozzle housing 90 and the inner spherical surface 36 as is depicted in FIG. 7.

It will of course be realized that various modifications can be made in the design and operation of the present invention without departing from the spirit thereof. Thus, while the principal preferred construction and mode of operation of the invention have been explained and what is now considered to represent its best embodiment has been illustrated and described, it should be understood that within the scope of the appended claims the invention may be practiced otherwise than as specifically illustrated and described.

I claim:

1. A steerable waterjet apparatus for watercraft wherein fluid is vectored upstream of a primary nozzle without substantial propulsion efficiency losses when said nozzle is manipulated to steer said watercraft through the water, said apparatus comprising:

an outer cylindrical housing member in communication with an upstream inlet opening at one end and, a convex spherically-shaped opposite downstream end having an opening formed therein, an inner cylindrical body positioned within, spaced from and concentric with said outer housing, said inner body at its upstream end being adjacent to an inducer pump and at its opposite downstream end, said inner body terminates in half a sphere, an outside wall of said inner body and an inside wall of said outer housing forming an annular chamber thereby.

an outer movable member forming a primary nozzle opening therein having an inside spherically-shaped concave surface that is interfitted with said convex spherically-shaped open ended outer housing member, said outer nozzle member is connected to said outer housing member and movable over said convex surface, of said outer housing member, a nozzle center piece, spaced from and adjacent said primary nozzle opening, the inner concave surface of said center piece slidably mates with the outer convex surface of said half sphere at said upstream end of said inner body, said center piece having a spike portion extended into the center of said primary nozzle formed by said movable nozzle member, said center piece having a multiplicity of support webs affixed to, equidistantly spaced one from the other and radially disposed between an inner surface of said movable nozzle member and an outer surface of said center piece, to maintain said extended spike portion within the center of said primary nozzle as said movable nozzle member is manipulated to steer the watercraft, the center piece serves to prevent turbulent flow which forms adjacent said half sphere of said inner body opposite said primary nozzle opening, and means to manipulate said nozzle member to effect watercraft steering.

2. A steerable waterjet apparatus for watercraft wherein fluid is vectored upstream of a primary nozzle without substantial propulsion efficiency losses when said nozzle is manipulated to steer said watercraft through the water, said apparatus comprising:

a fixed outer cylindrical housing member having an inlet opening at an upstream end and an open downstream end, an inner cylindrical body positioned within, spaced from and concentric with said outer housing, said inner body at its upstream end being adjacent an inducer pump and at its opposite downstream end, said inner body terminates in half a sphere, an outside wall of said inner body and an inside wall of said outer housing forming an annular chamber thereby, a multiplicity of radially disposed support web fluid flow straighteners are affixed to and equidistantly spaced within said annular chamber, said webs being positioned between said inducer pump and said downstream end of said outer housing, said downstream end of said outer housing is connected to a transition member at a first upstream end adopted to rotate 360° about a center line of said waterjet pump with respect to said fixed housing, said transition member at a second downstream end being connected to a rotatable nozzle housing member, forming a primary nozzle opening said second downstream end is so configured as to present a plane at the mating surface between said transition member and said nozzle member at an oblique angle to said center line of said waterjet pump, a nozzle center piece, spaced from and adjacent said primary nozzle opening, the inner concave surface of said center piece slidably mates with the outer convex surface of said half sphere at said upstream end of said inner body, said center piece having a spike portion extended into the center of said primary nozzle formed by said rotatable nozzle member, said center piece having a multiplicity of support webs affixed to, equidistantly spaced one from the other and radially disposed between an inner surface of said rotatable nozzle member and an outer surface of said center piece, to maintain said extended spike portion within the center of said primary nozzle as said rotatable nozzle housing member is manipulated to steer the watercraft, the center piece serves to break up turbulent flow which forms adjacent said half sphere of said inner body opposite said primary nozzle opening, and independent actuating means to manipulate both the rotatable transition member and the rotatable nozzle member obliquely connected to said transition member, so as to steer and trim said watercraft in a substantially horizontal and vertical plane through a wide variety of angles with respect to said center line of said waterjet pump.

* * * * *